United States Patent [19]

Budzich

[11] 4,290,448

[45] * Sep. 22, 1981

[54] LOAD RESPONSIVE CONTROL VALVE

[76] Inventor: Tadeusz Budzich, 80 Murwood Dr., Moreland Hills, Ohio 44022

[ * ] Notice: The portion of the term of this patent subsequent to Jun. 24, 1997, has been disclaimed.

[21] Appl. No.: 42,211

[22] Filed: May 24, 1979

Related U.S. Application Data

[63] Continuation of Ser. No. 960,767, Nov. 15, 1978, Pat. No. 4,209,039, which is a continuation-in-part of Ser. No. 947,626, Oct. 2, 1978, abandoned.

[51] Int. Cl.[3] ..... F15B 13/08

[52] U.S. Cl. ..... 137/596.13; 91/451

[58] Field of Search ..... 91/451; 137/596.13

[56] References Cited

U.S. PATENT DOCUMENTS 4,209,039 6/1980 Budzich ..... 137/596

*Primary Examiner*—Gerald A. Michalsky

[57] ABSTRACT

A pressure compensated load responsive flow control valve for use in a system controlling a plurality of loads. The system is powered by a single, fixed displacement pump. The flow control valve is equipped with a load responsive control, which during simultaneous control of multiple loads automatically maintains the pump discharge pressure at a level higher by a constant pressure differential than the pressure required by the largest load being controlled and which while system loads are not being controlled using external source of pressure fully opens pump bypass and reduces the pump bypass pressure to a minimum level.

10 Claims, 3 Drawing Figures

14
W
13
W
15
18

14
192
193
W
63
52
64
49
55
12
194
67
17
69
68
70
22
170
13
190
191
W
198
195
172
25
39
23
40
171
174
31
11
179
175
196
197
37
38
202
177
176
173
168
199
42
41
201
43
178
169
46
17
194
45
44
21
186
184
209
208
207
187
189
180
181
17
48
200
152
153
158
150
154
151
151a
149
146
127
204
203
147
156
148
188
185
205
155
159
167
134
210
211
140
161
160
139
143
142
141
206
163
144
135
164
145
133
129
132
128
20

162
165
166
137
131
136
138
16
15
17

LOAD RESPONSIVE CONTROL VALVE

This application is a continuation of application Ser. No. 960,767, filed Nov. 15, 1978, for "Load Responsive Control Valve," now U.S. Pat. No. 4,209,039, which is a continuation in part of Ser. No. 947,626, filed Oct. 2, 1978, for "Load Responsive Control Valve", now abandoned.

BACKGROUND OF THE INVENTION

This invention relates generally to load responsive bypass flow control of a fixed displacement pump, which automatically maintains pump discharge pressure higher, by a constant pressure differential, than the load pressure signal transmitted from system control valves.

In more particular aspects this invention relates to bypass flow control of a fixed displacement pump, which is controlled by a pilot valve responsive to load pressure signals transmitted from system control valves.

In still more particular aspects this invention relates to an unloading control of load responsive bypass flow control of a fixed displacement pump, which in absence of load pressure signal using an external source of pressure fully opens pump bypass and permits the load responsive bypass flow control to bypass pump flow to system reservoir at a minimum pressure level.

During control of positive load the load responsive bypass flow control of a fixed displacement pump automatically maintains a constant pressure differential between the pump discharge pressure and the load pressure. Depending on the type of control and on the required response characteristics this constant pressure differential may be quite high. Since during standby condition the load responsive bypass flow control will maintain the system pressure at a level equal to the constant pressure differential of the control, the standby horsepower loss can be quite high.

SUMMARY OF THE INVENTION

It is therefore a principle object of this invention to provide a load responsive bypass flow control of a fixed displacement pump, which maintains a constant pressure differential between pump discharge and load pressure with a load responsive unloading control.

It is another object of this invention to provide a load responsive unloading control, which will lower the system standby pressure, while system is not controlling a load to a minimum level, by using an external source of pressure to fully open pump bypass, therefore reducing the standby horsepower loss of the system.

Briefly the foregoing and other additional objects and advantages of this invention are accomplished by providing a novel load responsive unloading valve using an external source of pressure in combination with a two stage load responsive pilot operated differential bypass valve. With the system in standby condition the load responsive unloading valve lowers the system standby pressure to a minimum level, reducing horsepower loss in the standby condition of the system.

Additional objects of the invention will become apparent when referring to the preferred embodiments as shown in the accompanying drawings and described in the following detailed description.

DESCRIPTION OF THE PREFERRED EMBODIMENTS

Figure 1:
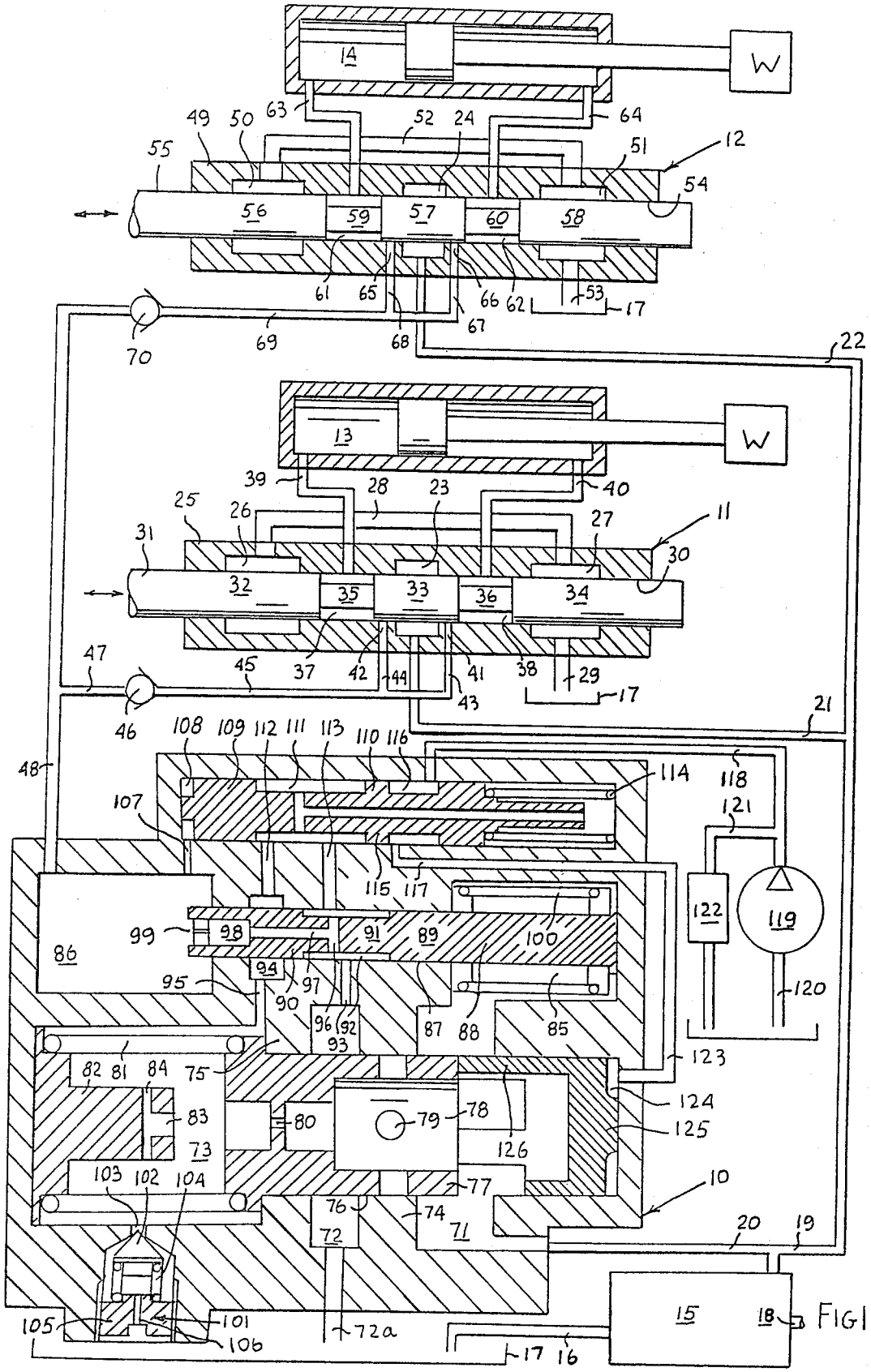
FIG. 1 is a longitudinal sectional view of an embodiment of two stage pilot operated differential bypass valve equipped with load responsive unloading valve used in control of flow from schematically shown direction control valves with system lines, pump and reservoir shown diagramatically.

Referring now to the drawings, FIG. 1 shows a section through a differential bypass valve assembly, generally designated as 10, connected into a circuit with direction control valve assemblies, generally designated as 11 and 12, controlling actuators 13 and 14 which drive loads W. Although in FIG. 1 for purposes of demonstration of the principle of the invention, differential bypass valve assembly 10 and direction control valve assemblies 11 and 12 are shown separated, in actual application they would be most likely contained in a single valve housing or would be bolted together as sections of a sectional valve assembly. As shown, fixed displacement pump 15 has an inlet line 16 which supplies fluid to pump from a reservoir 17 and the pump is driven through a shaft 18 by a prime mover not shown. The pump has an outlet line 19 which connects through line 20 to differential bypass valve assembly 10 and through lines 21 and 22 with inlet chambers 23 and 24 of direction control valve assemblies 11 and 12 respectively.

Direction control valve 11 has a valve housing 25 which defines inlet chamber 23 and also defines outlet chambers 26 and 27, which are connected to each other by a duct 28 and are further connected by a line 29 to reservoir 17. Valve housing 25 axially guides in a valve bore 30 a valve spool 31 which by lands 32, 33 and 34 and stems 35 and 36 defines load chambers 37 and 38, which are connected through lines 39 and 40 to actuator 13. Load sensing ports 41 and 42 are connected through lines 43, 44 and 45 to a check valve 46 which in turn is connected by lines 47 and 48 to differential bypass valve assembly 10.

Similarly direction control valve assembly 12 has a valve housing 49 which defines inlet chamber 24 and also defines outlet chambers 50 and 51, which are connected to each other by a duct 52 and further connected by a line 53 to reservoir 17. Valve housing 49 axially guides in a valve bore 54 a valve spool 55 which by lands 56, 57 and 58 and stems 59 and 60 defines load chambers 61 and 62, which are connected through lines 63 and 64 to actuator 14. Load pressure sensing ports 65 and 66 are connected through lines 67, 68 and 69 to a check valve 70, which in turn is connected by line 48 to differential bypass valve assembly 10.

The differential bypass valve assembly 10 has a supply chamber 71 communicating with pump 15, an exhaust chamber 72 communicating through a line **72*a* with reservoir 17 and a control chamber 73, those chambers being separated by partitions 74 and 75**. A bore 76 passing through partitions 75 and 74 interconnects supply chamber 71, exhaust chamber 72 and control chamber 73 and axially guides a bypass member 77. Bypass member 77 has an inner bore 78 provided with extending circumferentially spaced ports 79 blocked, as shown in position in FIG. 1, by partition 74. Inner bore 78 communicates through a leakage orifice 80 in bypass member 77 with control chamber 73. A control spring 81, interposed between bypass member 77 and a stop 82, biases bypass member 77 towards position, as shown in FIG. 1. Stop 82 is provided with passages 83 and 84.

A portion of space 85 of supply chamber 71 is interconnected with a load pressure chamber 86 by a bore 87 axially guiding a differential pressure pilot valve 88. Differential pressure pilot valve 88 has lands 89 and 90 connected by a stem 91 defining an exhaust space 92 connected by a drilling 93 to exhaust chamber 72. A control space 94 in communication with bore 87 is connected by a drilling 95 with control chamber 73. Exhaust space 92 is connected through drillings 96, 97 and 98 and a leakage orifice 99, in differential pressure pilot valve 88, with load pressure chamber 86. A differential spring 100 in space 85 biases differential pressure pilot valve towards position as shown in FIG. 1.

Control chamber 73 is operationally connected by a high pressure pilot relief valve, generally designated as 101, with reservoir 17. High pressure pilot relief valve 101 has a poppet 102 biased into sealing engagement with a passage 103 by a relief valve spring 104, the preload of which is adjusted by a threaded insert 105, equipped with an exhaust flow passage 106.

The load pressure chamber 86 is connected through passage 107 with annular space 108, in direct communication with land 109 of an unloading spool 110. Annular space 111 is connected through passage 112, control space 94 and drilling 95 with control chamber 73, annular space 111 being also connected by passage 113, exhaust space 92, exhaust chamber 72 and line 72*a* with system reservoir 17. The unloading spool 110 is subjected to biasing force of the spring 114, which with system at rest maintains it in the position as shown in FIG. 1. The unloading valve spool 110 has land 115 and annular space 116 connecting end ports of passage 117 and line 118. Line 118 is connected to pump 119, which is supplied with suction oil by line 120 and provided with bypass line 121 and bypass relief valve 122. Space containing springs 114 is connected by drill passages with annular space 111. Passage 117 is connected by line 123 with cylinder bore 124 guiding unloading piston 125, which with lugs 126 engages bypass member 77.

All of the basic system components, as shown in FIG. 1, are at rest in unloaded or unactuated position, with fixed displacement pump 15 and pump 119 not working. With pump 119 started up, rising pressure in line 118 will be transmitted through annular space 116, passage 117 and line 123 to annular space of cylinder bore 124, where it will react on the cross-sectional area of unloading piston 125, which with lugs 126 will engage bypass member 77. Since control chamber 73 is vented through drilling 95, control space 94, passage 112, annular space 111, passage 113, exhaust space 92 and exhaust chamber 72 to system reservoir 17, the unloading piston 125, subjected to pressure of pump 119, will move the bypass member 77 against the biasing force of control spring 81 all the way to the left to a point, where it will engage stop 82. In this position of the bypass member 77 the supply chamber 71 will be fully connected by inner bore 78 and ports 79 to the exhaust chamber 72 and therefore to the system reservoir 17.

With fixed displacement pump 15 started up all of the fluid supplied by the pump to the supply chamber 71 will be directly bypassed through inner bore 78 and ports 79 to the exhaust chamber 72 and system reservoir 17 at minimum pressure, corresponding to the resistance to flow of those passages. Therefore since the energy to compress the control spring 81 is supplied by the pump 119, the fixed displacement pump 15, in its full bypass position, will be delivering flow at minimum pressure level, corresponding to the minimum standby horsepower loss.

Assume that pressure in the load pressure chamber 86 was sufficiently increased to move the unloading control spool 110 from left to right, blocking with land 109 passage 112 and thereforce isolating the control chamber 73 from system reservoir 17, while connecting, through displacement of land 115, outlet port of passage 117 with annular space 111. In this position of the unloading spool 110 annular space of cylinder 124 is connected through line 123, passage 117, annular space 111, passage 113, exhaust space 92 and drilling 93 to the exhaust chamber 72. Since the supply chamber 71 is connected through inner bore 78 and leakage orifice 80 with the control chamber 73 and since annular space of cylinder 124 is connected to system reservoir, the control spring 81 will start moving the bypass member 77 and the unloading piston 125 from left to right, decreasing the effective area of ports 79 and therefore increasing the resistance to the bypass flow and as a result increasing the discharge pressure of the fixed displacement pump 15. Increasing pressure in the supply chamber 77, reacting on the cross-sectional area of the unloading piston 125, will move it all the way from left to right, to the position as shown in FIG. 1 and out of contact with the bypass member 77. Increasing pressure in the supply chamber 71, transmitted to space 85, will react on the cross-sectional area of differential pressure pilot valve 88, generating a force, which tends to move it from right to left, against the biasing force of differential spring 100 and low pressure in the load pressure chamber 86.

In conventional single stage differential pressure bypass valves the minimum bypass pressure is dictated by the preload in the control spring 81 and the fixed displacement pump, in its unloaded condition, must generate sufficient pressure to keep the control spring 81 compressed and the bypass open. This condition represents the minimum standby horsepower loss, which with large pumps can be comparatively large. The selection of the minimum preload of the control spring 81 is critical, not only from the standpoint of minimum losses in the bypass condition, but also from the standpoint of response of the control. Low preload of control spring 81, providing low bypass loss, produces a slow acting control, in the direction of reduction of the bypass flow. Consequently the system pressure rise of such a control will be comparatively slow. Increase in preload in the control spring 81 will provide a fast responding control, but will also provide high bypass pressure and high standby horsepower loss. By providing a small external fluid power source and using the unloading spool and unloading piston of the present invention, a differential pressure bypass control can have a very high response, low bypass pressure and consequently low standby horsepower loss.

As soon as pressure in supply chamber 71 and space 85 generates a sufficiently high force on cross-sectional area of differential pressure pilot valve 88 to overcome the preload of differential spring 100 and low pressure in the load pressure chamber 86, differential pilot valve 88 will move from right to left, trying to displace fluid from load pressure chamber 86. The resulting rise in pressure in load pressure chamber 86 will first close check valves 46 and 70, isolating load pressure chamber 86 from direction control valve assemblies 11 and 12. Rising pressure in load pressure chamber 86 will induce, in a well known manner, fluid flow through leakage orifice 99, permitting movement of differential pressure pilot valve 88 from right to left, the speed of the movement initially being proportional to rate of leakage through leakage orifice 99 and therefore being a function of pressure in load pressure chamber 86 and cross-sectional area of differential pilot valve 88. The movement of differential pressure pilot valve 88, through displacement of land 90, will connect exhaust space 92 with control space 94, permitting a flow of fluid from pressurized control chamber 73 to reservoir 17 through drilling 95, control space 94, exhaust space 92, drilling 93, exhaust chamber 72 and drilling 72*a*. The pressurized fluid, lost in this way from control chamber 73, must be replenished from supply chamber 71, through leakage orifice 80. In a well known manner, pressure drop through leakage orifice 80 caused by the resulting fluid flow will maintain control chamber 73 at a lower pressure level than supply chamber 71, subjecting bypass member 77 to a force, tending to move it from right to left, against biasing force of control spring 81. Once the pressure drop through leakage orifice 80 creates a sufficiently large pressure differential between control chamber 73 and supply chamber 71 and generates a sufficiently large force, acting on bypass member 77, bypass member 77, will move from right to left, against biasing force of control spring 81. This movement will gradually increase the passage between ports 79 of bypass member 77 and exhaust chamber 72, connecting chamber 71 with reservoir 17. Under those conditions the fluid supplied by pump 15 to supply chamber 71 will be bypassed to exhaust chamber 72 and a condition of equilibrium will be established, under which sufficiently high pressure is maintained in supply chamber 71 to keep differential pressure pilot valve 88 displaced against biasing force of differential spring 100, and to induce sufficient flow from control space 73 to generate a sufficiently high pressure drop through leakage orifice 80, to provide sufficient force to maintain bypass member 77 in its bypass position. Therefore, with passage 112 closed by land 109 of unloading spool 110 under full bypass condition, pressure in the supply chamber 71 will be equal to the biasing force of differential spring 100 divided by the cross-sectional area of differential pressure pilot valve 88. The cross-sectional area of differential pressure pilot valve 88 is small and its movement from its neutral position to connect exhaust space 92 and control space 94 is also small, so that only a minimal displacement of fluid from the load pressure chamber 86 is required to bring differential pressure pilot valve 88 into its modulating position, resulting in a very fast response, even at very small leakage levels through leakage orifice 99. The biasing force of the differential spring 100 is so selected that proper operation of direction control valve assemblies 11 and 12 is assured.

Assume that during the equilibrium bypass condition of differential bypass valve assembly 10, the valve spool 31 is initially displaced from left to right, displacement of land 33 connecting load chamber 37 with load sensing port 42. Assume also that load chamber 37 is subjected to pressure of positive load W, transmitted from actuator 13 through line 39. Load pressure from load sensing port 42, transmitted through lines 44 and 45, will open check valve 46 and pressurize load pressure chamber 86, while maintaining the check valve 70 closed. The rising pressure in load pressure chamber 86 will maintain the unloading spool 110 in a position in which passage 112 is closed and will disrupt the equilibrium of forces, acting on differential pressure pilot valve 88, moving it from left to right and closing the passage between control space 94 and exhaust space 92. As a result, the pressure drop through leakage orifice 80 will be reduced, the only flow through leakage orifice 80 being that caused by resulting displacement from left to right of the bypass member 77, under action of biasing force of spring 81, which will gradually reduce the effective area of ports 79 and proportionally increase the pressure in supply chamber 71. The rising pressure in supply chamber 71 and space 85 will counteract the effect of rising pressure in load pressure chamber 86, until a point is reached, at which movement of the differential pressure pilot valve 88 from right to left will reestablish communication between control space 94 and exhaust space 92. This in turn, as previously described, will induce flow from control space 73, which in turn will position bypass member 77 in a new position, equivalent to the new condition of equilibrium, under which pressure in the supply chamber 71 will be maintained at a level, higher by a constant pressure differential, equal to the biasing force of the differential spring 100 divided by the cross-sectional area of the differential pressure pilot valve 88, than the load pressure signal transmitted from the load W and actuator 13 to load pressure chamber 86. Under these conditions differential pressure pilot valve 88 will regulate the flow from control chamber 73 and resulting pressure differential between control chamber 73 and supply chamber 71, to regulate the position of the bypass member 77, to maintain the pressure in supply chamber 71 at a level, higher by a constant pressure differential, than the load pressure signal transmitted to the load pressure chamber 86.

Assume that valve spool 31 is further displaced from left to right connecting load chamber 37 and load sensing port 42 with inlet chamber 23 while at the same time connecting load chamber 38 with outlet chamber 27. As previously described inlet chamber 23 is maintained by pump 15 at a pressure, higher by a constant pressure differential, than pressure in load chamber 37. Fluid flow will take place from inlet chamber 23 to load chamber 37, this flow being proportional to the area of opening between those two chambers, since a constant pressure differential is maintained between them. Flow into actuator 13, of fluid supplied by the pump 15, will momentarily lower the pump discharge pressure and disturb the equilibrium of differential pressure valve assembly 10. As a result new bypass position of the bypass member 77 will be established and the differential pressure valve assembly 10 will revert to the condition of equilibrium, at which sufficient quantity of fluid from the pump 15 is bypassed to reservoir 17 by the bypass member 77, to maintain, in a manner as previously described, constant pressure differential between load chamber 37 and supply chamber 71. Any sudden rise in load W and corresponding increase in pressure in load chamber 37 and therefor load pressure chamber 86 will automatically reposition, in a manner as previously described, bypass member 77, to increase the pressure in supply chamber 71 and inlet chamber 23, to establish an equilibrium condition, at which a constant pressure differential is maintained between inlet chamber 23 and load chamber 37. Under these conditions, in a well known manner, flow supplied from the inlet chamber 23 to actuator 13 will be proportional to displacement of valve spool 31 from the position at which load chamber 37 and inlet chamber 23 become connected.

Displacement of valve spool 31 from right to left will at first connect load sensing port 41 through lines 43, 45, check valve 46 and line 48 to load pressure chamber 86. Further movement of valve spool 31 interconnects load chamber 38 with inlet chamber 23 and also interconnects load chamber 37 with outlet chamber 26. The response of the control and the sequence of operations will be the same as those resulting from the displacement of the valve spool 31 in the opposite direction which has already been described in detail.

Assume that valve spools 31 and 55 are simultaneously displaced from left to right, connecting load sensing ports 42 and 65 with load chambers 37 and 61. Assume also that pressure of positive load exists in both load chambers and that load chamber 61 is subjected to higher pressure than load chamber 37. The higher pressure signal from load chamber 61 will be transmitted through load pressure sensing port 65, lines 68 and 69, check valve 70 and line 48 to load pressure chamber 86. The higher load pressure signal from line 48 will also be transmitted by line 47 to check valve 46, in a well known manner maintaining it closed and therefore isolating load sensing port 42 from load pressure chamber 86.

The response of the system control to high pressure signal in load pressure chamber 86 has already been described in detail. However, if resulting pressure in control chamber 73, due to the system load demand will exceed a level equal to the preload in the relief valve spring 104 divided by the cross-sectional area of passage 103, the high pressure pilot relief valve 101 will open and in a well known manner bypass flow from control chamber 73 to reservoir 17. In a manner, as previously described when referring to flow from control chamber 73 through bypass created by differential pressure pilot valve 88, the resistance to flow through orifice 80 will create an unbalance of forces acting on the bypass member 77, moving it from right to left and reducing the system pressure to the level, equivalent to the setting of the high pressure pilot relief valve 101. Under these conditions the high load pressure, existing in load pressure chamber 86, will maintain the differential pressure pilot valve 88 in its fully closed position, the system pressure being maintained at a constant value by high pressure pilot relief valve 101, the characteristics of the flow control valve, of maintaining constant pressure differential between pump and load pressures, being momentarily lost. With drop in load pressure below the setting of the high pressure relief valve, the valve control will assume its normal mode of operation. Since during simultaneous operation of two loads, the control system will maintain a constant pressure differential between the pump pressure and the pressure of the highest of the system loads, the flow control feature of the lower loads will be lost.

With valve spools 31 and 55 in their neutral position no pressure signal will be transmitted to the load pressure chamber 86 and the load pressure chamber 86, through action of the leakage orifice 99, will be subjected to atmospheric pressure. The unloading spool 110, biased by the spring 114, will move to the position as shown in FIG. 1, connecting through passage 112 the control chamber 73 with the system reservoir and connecting fluid under pressure from the pump 119 to the unloading piston 125. In a manner, as previously described, the unloading piston 125, utilizing energy supplied by pump 119, will move the bypass member 77 into full bypass position.

Load pressure signal from the system valves will increase pressure in the load pressure chamber 86, which will move the unloading spool 110 to the right, simultaneously cutting off communication between the control chamber 73 and the system reservoir, disconnecting the pump 119 from the unloading piston 125 and connecting the unloading piston 125 to system reservoir 17. Then, in a manner as previously described, through action of differential pressure pilot valve 88, which will reposition the bypass member 77, the pump discharge pressure will be automatically maintained at a level, higher by a constant pressure differential, than the load pressure signal.

Figure 2:
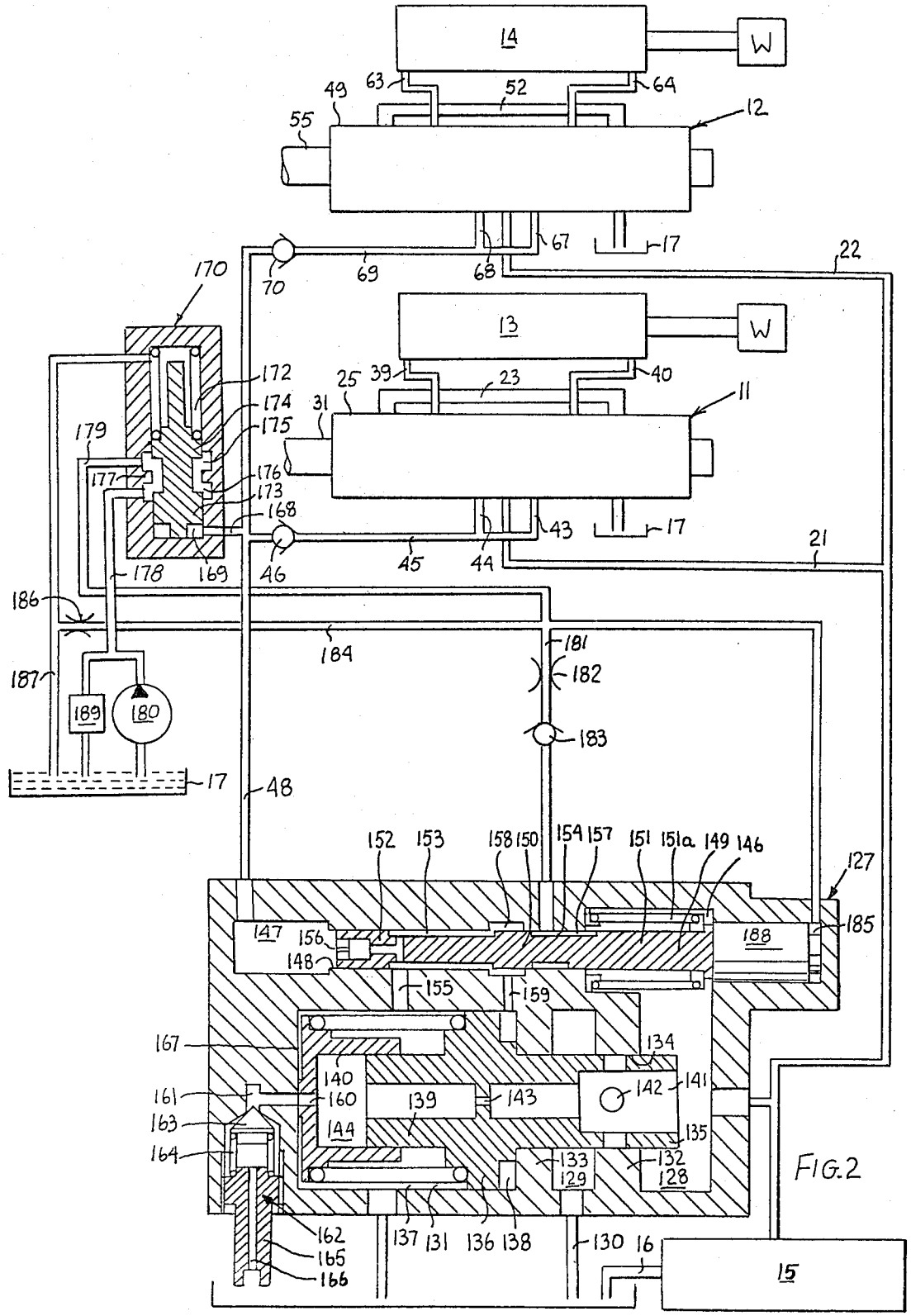
FIG. 2 is a longitudinal sectional view of another embodiment of a two stage pilot operated differential bypass valve equipped with load responsive unloading valve used in control of flow from schematically shown direction control valves with system lines, pump and reservoir shown diagramatically.

Referring now to FIG. 2, an identical arrangement of direction control valve assemblies 11 and 12 are connected to fixed displacement pump 15 and are phased by check valves 46 and 70 to another embodiment of a differential bypass valve assembly, generally designated as 127. The differential bypass valve assembly 127 has a supply chamber 128 communicating with pump 15 through line 20, an exhaust chamber 129 communicating through a line 130 with reservoir 17 and a chamber 131, these chambers being separated by partitions 132 and 133. A bore 134 passing through partitions 132 and 133 interconnects supply chamber 128, exhaust chamber 129 and chamber 131 and axially guides a bypass member 135. Bypass member 135 has a piston 136, dividing chamber 131 into a low pressure zone 137 and a control pressure zone 138. Bypass member 135 has also an extension 139 at one end slidably guiding a reaction cylinder 140 and an inner bore 141 at the other end provided with radially extending circumferentially spaced ports 142 blocked in the position as shown in FIG. 2 by partition 132. Inner bore 141 communicates through a leakage orifice 143 with a space 144 in reaction cylinder 140. A control spring 145 is interposed between reaction cylinder 140 and piston 136, maintaining bypass member 135 in position as shown in FIG. 2.

A portion of space 146 of supply chamber 128, is interconnected with a load pressure chamber 147 by a bore 148, axially guiding a differential pressure pilot valve 149. Differential pressure pilot valve 149 has lands 150, 151 and 152 defining an exhaust space 153 and a high pressure space 154. Exhaust space 153 is connected by a drilling 155 to low pressure zone 137, communicating with reservoir 17 and also communicates through a leakage orifice 156 with load pressure chamber 147. High pressure space 154 communicates through a groove 157 a differential pressure pilot valve 149 with space 146. A control space 158 is connected through a drilling 159 with control pressure zone 138. Space 144 in reaction cylinder 140 is connected through a drilling 160 with a port 161, sealed by a high pressure pilot relief valve, generally designated as 162, which has a poppet 163, a spring 164 and a threaded body 165, equipped with a passage 166. Reaction cylinder 140 is maintained in sealing engagement with a face 167 by preload in control spring 145 and by the pressure in space 144.

Load pressure chamber 147 is connected by lines 48 and 168 with space 169 of an unloading valve, generally designated as 170. The unloading valve 170 is provided with an unloading spool 171, biased by spring 172 towards position as shown in FIG. 2. The unloading spool 172 is provided with lands 173 and 174, which cross-connect annular spaces 175 and 176, divided by web 177. Annular space 176 is connected by line 178 with a discharge port of a pump 180. Annular port 175 is connected through line 179, line 181, restrictor orifice 182 and check valve 183 with groove 157. Annular space 175 is also connected through line 184 with space 185 and through leakage orifice 186 with line 187 leading to reservoir 17. Space 185 communicates directly with the free floating piston 188, which provides a stop for the differential pressure pilot valve 149. The pump 180, providing an external source of fluid to the unloading valve 170, is supplied with a suitable bypass 189 leading to reservoir 17.

All of the basic system components, as shown in FIG. 2, are at rest in unloaded or unactuated position, with the pump 180 and the fixed displacement pump 15 not working. When the pump 180 is started up fluid under pressure is supplied through line 178, annular spaces 176 and 175, line 179 and line 184 to space 185. The fluid under pressure from the pump 180 is also supplied from line 184 to line 181, restrictor orifice 182 and check valve 183 to groove 157, which in position of differential pressure pilot valve 149 is connected to the supply chamber 128. Line 184, subjected to the pressure fluid is also connected by leakage orifice 186 with line 187 leading to reservoir 17. Only a minor portion of fluid, supplied from pump 180, will go through the restrictor orifice 182 and leakage orifice 186, most of the fluid flow being supplied to space 185 where, reacting on the cross-sectional area of free floating piston 188 will move it from right to left, moving the differential pressure pilot valve 149 and isolating groove 154 from the supply chamber 128 and connecting it to control space 158. Therefore fluid under pressure supplied from pump 180 through line 181 to groove 154 will be supplied through control space 158 and drilling 159 to control pressure zone 138 where, reacting on the effective cross-sectional area of piston 136 will move the bypass member 135 all the way to the left, fully connecting the supply chamber 128 through inner bore 141 and ports 142 with the exhaust chamber 129, which is directly connected to the reservoir 17. As long as the pump 180 will supply pressure and as long as the unloading valve 170 remains in the position as shown in FIG. 2, the bypass member 135 will fully interconnect the fluid supply chamber 128 with the system reservoir.

Under those conditions, when the fixed displacement system pump 15 is started up, its total fluid delivery will be bypassed from fluid supply chamber 128 through inner bore 141 and ports 142 to the exhaust chamber 129 at minimum pressure, equivalent to the resistance to flow of those passages. Therefore in the bypass condition the standby horsepower loss will be small.

Increase in load signal pressure, transmitted from system valves through line 48 to the load pressure chamber 147, will also increase the pressure in space 169 and move the spool of the unloading valve 170 upwards, the land 173 and web 177 cutting off communication between annular space 176 and annular space 175. Since the line 184 is open to system reservoir by leakage orifice 186, the free floating piston 188 and the differential pressure pilot valve 149 will move to the right, the land 150 opening control space 158 and therefore control pressure zone 138 through exhaust space 153, drilling 155 and low pressure zone 137 to system reservoir. Under action of control spring 145 the bypass member 135 will move to the right increasing the resistance to flow of the bypass fluid through ports 142. The rising fluid pressure in supply chamber 128 supplied to space 146 will react on the cross-sectional area of free floating piston 188 and on the cross-sectional area of differential pressure pilot valve 149, generating a force, which would tend to move it from right to left against biasing force of a differential spring 151*a*. The load pressure chamber 147 is subjected to a low pressure and connected to system reservoir 17 through leakage orifice 156, exhaust space 153, drilling 155 and low pressure zone 137. As soon as pressure in supply chamber 128 and space 146 generates a sufficiently high force on cross-sectional area of differential pressure pilot valve 149 to overcome the preload of differential spring 151*a* and pressure in the load pressure chamber 147, the differential pilot valve 149 will move from right to left, trying to displace fluid from load pressure chamber 147. The resulting rise in pressure in load pressure chamber 147 will first close check valves 46 and 70, isolating load pressure chamber 147 from directional control valve assemblies 11 and 12. Rising pressure in load pressure chamber 147 will induce, in a well known manner, fluid flow through leakage orifice 156, permitting movement of differential pressure pilot valve 147 from right to left, the speed of movement being proportional to rate of leakage through leakage orifice 156 and therefore being a function of pressure in load pressure chamber 147 and cross-sectional area of differential pressure pilot valve 149. The movement of differential pressure pilot valve 149 through displacement of land 150 will first close communication between control space 158 and exhaust space 123 and then open control space 158 to high pressure groove 157. The rising pressure in control space 158 will be transmitted through drilling 159 to control pressure zone 138 and will react on the effective cross-sectional area of piston 136, compressing control spring 145 and moving the bypass member 135 from right to left. The differential pressure pilot valve 149 will modulate, maintaining bypass member 135 in a bypass position, which in turn will maintain the pressure in supply chamber 128 at a level, equal to the preload of the differential spring 151*a* divided by the cross-sectional area of differential pressure pilot valve 149. An increase in pressure in load pressure chamber 147 will move the differential pressure pilot valve 149 from left to right, connecting control space 158 with exhaust space 153. With a drop in pressure in control pressure zone 138 under the action of the control spring 145, the bypass member 135 will move from left to right, decreasing the amount of bypass flow. As a result the pressure in the supply chamber 128 will start to rise, until it will overcome the combined force of the differential spring 151*a* and force generated by the pressure in load pressure chamber 147, acting on cross-sectional area of differential pressure pilot valve 149, moving it back to its modulating position. Therefore differential pressure pilot valve 149 will always control the position of the bypass member 135 to maintain a constant pressure differential between supply chamber 128 and load pressure chamber 147, this pressure differential being equal to the preload of the differential spring 151*a* divided by the cross-sectional area of the differential pressure pilot valve 149. If the pressure in supply chamber 128 and space 144 rises to a level, at which it overcomes the preload of spring 164 of the high pressure pilot relief valve 162 a flow of fluid is induced from space 144 to reservoir 17. This flow of fluid from space 144 is supplied through leakage orifice 143 from supply chamber 128 and creates a pressure drop through leakage orifice 143 which in turn, in a well known manner, unbalances the forces acting on bypass member 135, moving it from right to left to a position where sufficient fluid from the supply chamber 128 is bypassed to exhaust chamber 129 to maintain the discharge pressure of pump 15 at the pressure setting of the high pressure relief valve 162. While the system pressure is maintained by the high pressure pilot relief valve 162, the differential pressure pilot valve 149 is maintained by high pressure in load pressure chamber 147 in the position as shown in FIG. 2, with control space 158 connected to exhaust space 153. With the drop in pressure in the load pressure chamber 147, high pressure pilot relief valve 162 closes and the differential pressure pilot valve 149 reverts to its modulating position, maintaining, as previously described, a constant pressure differential between supply chamber 128 and load pressure chamber 147.

With valve spools 31 and 55 in their neutral position no load pressure will be supplied from direction control valve assemblies 11 and 12 and therefore through action of leakage orifice 156 the load pressure chamber 147 will be maintained at atmospheric pressure. Spring 172 will maintain the unloading spool of unloading valve 170 in position as shown in FIG. 2, in a manner as previously described the pump flow being bypassed at minimum pressure level to the system reservoir 17.

Actuation of direction control valve assemblies 11 and 12, in a manner as previously described when referring to FIG. 1, will transmit through check valves 46 and 70 the highest positive load system pressure to the load pressure chamber 147. Increasing pressure in the load pressure chamber 147 will move the unloading spool of the unloading valve 170 upwards, deactivating the unloading circuit. The differential bypass valve assembly 127 will respond, in a manner as already described above, always maintaining a constant pressure differential between supply chamber 128 and load pressure chamber 147.

The basic operation of the differential bypass valve assembly 10 of FIG. 1 and 127 of FIG. 2 is the same, since both of them maintain a constant pressure differential between their respective supply chambers and load pressure chambers. Furthermore both of those valves maintain this constant pressure differential by regulating, through change in position of a bypass member, the amount of fluid bypassed from supply chamber to system reservoir. Both of those valves provide high response with only minimal leakage from load pressure chambers and both of those valves use energy of the pump in moving bypass members. Those valves differ only in the way the respective differential pressure pilot valves control the position of the bypass members. In differential bypass valve assembly 10 the differential pressure pilot valve 88 regulates the control flow from control chamber 73 and by subjecting bypass member 77 to unbalanced force condition, regulates its position. In differential bypass valve assembly 127 differential pressure pilot valve 149 regulates the pressure in control pressure zone 138, therefore controlling the position of the bypass member 135 and the quantity of bypass flow of fluid between supply chamber 128 and system reservoir.

Through the use of two stage differential bypass valve assemblies 10 and 127 and specifically through the use of differential pressure pilot valves 88 and 149 very fast response of the control can be obtained, both while increasing and decreasing the bypass flow of the control, in response to the load pressure signal. While increasing the bypass flow, because of its extremely small control stroke and small cross-sectional area, the response of the differential pressure pilot valve, even with minimum leakage through leakage orifices 99 and 156 is very fast. On the other hand when decreasing the bypass flow, the flows through the load sensing circuits, resulting from the displacement of the differential pressure pilot valve through its control stroke are so small that the attenuation of the load pressure signal in the control lines is minimal. At the same time the response of the bypass members 77 and 135 to the control signal of the differential pressure pilot valves 88 and 149 is very fast, since energy derived from pump circuit is utilized to displace comparatively large bypass members 77 and 135.

The use of the unloading circuits of FIGS. 1 and 2, in which the energy derived from an external pressure source is used to move and maintain the bypass member in a fully open position, results in selected minimum pressure drop through the bypass mechanism and therefore a low pump standby horsepower loss. This beneficial reduction in the standby horsepower loss of the fixed displacement system pump is achieved, while response of the bypass mechanism can be maintained at any desired level. Furthermore, due to the use of unloading circuits of this invention, all of the above benefits can be obtained, while permitting a choice of relatively high pressure differential, between the pump pressure and the load pressure, when the system loads are being controlled, which provides improved system performance.

The bypass unloading mechanisms of bypass valve assemblies 10 and 127 of FIGS. 1 and 2, as previously described, respond to absence of the load pressure signal, to unload pump discharge pressure circuit. Those bypass unloading mechanisms are also activated towards position of bypass control by the presence of the minimum load pressure signal. There are instances, when the system actuators 13 and 14 are subjected to zero load. To provide the pressure, necessary for deactivation of the unloading mechanism, the resistance to flow through ports 79 of the bypass member 77 of FIG. 1 and through ports 142 of the bypass member 135 of FIG. 2 is so selected, that a certain minimum pressure differential is maintained between supply chambers 71 and 128 and the exhaust chambers 72 and 129 of FIGS. 1 and 2. Upon actuation of valve spool 31 of FIG. 1 load sensing line 41 or 42 is connected to minimum pressure existing during bypass condition in the supply chamber 71, which is selected sufficiently high to actuate the unloading spool 110 into position, in which it will activate the control of the bypass valve assembly. Automatically, in a manner as previously described, the bypass member 77 or 135 will move into the modulating position, maintaining a constant pressure differential between the pump outlet pressure and the load signal pressure, transmitted to the load pressure chambers 86 and 147.

When referring to FIGS. 1 and 2 the bypass valve assemblies 10 and 127 control the bypass flow, while using the energy derived from the pump discharge pressure circuit. This necessitates maintenance of certain minimum residual pressure in the supply chambers 71 and 128 in full bypass condition. To further minimize the bypass loss the energy derived from pumps 119 and 180 can be used not only to unload the bypass mechanism in bypass condition, but actually to provide the pressure fluid for controlling the bypass flow in modulating conditions of bypass valve assemblies 10 and 127. Such a solution is shown in FIG. 3.

Figure 3:
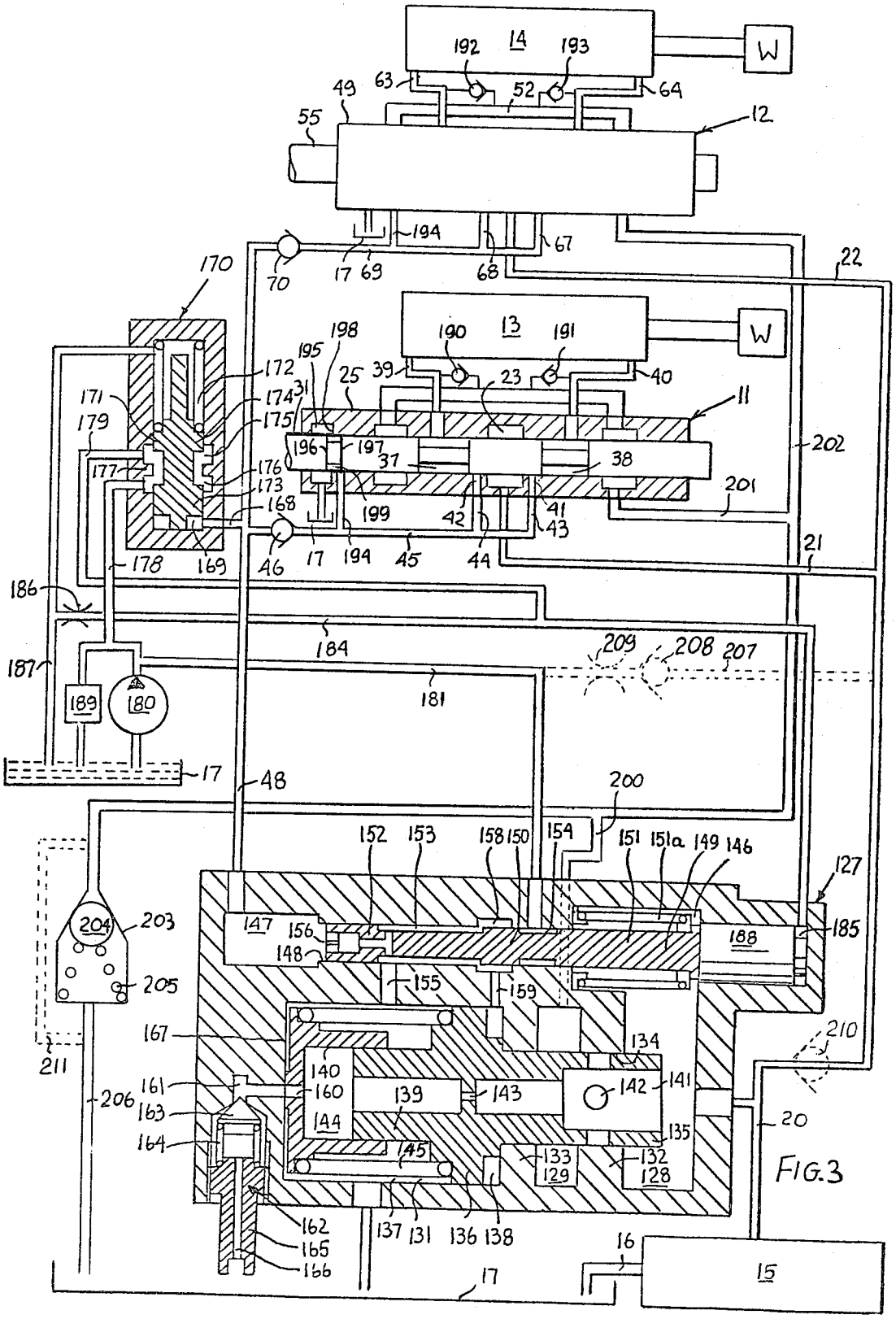
FIG. 3 is a longitudinal sectional view of the embodiment of a two stage pilot operated differential bypass valve equipped with load responsive unloading valve of FIG. 2 modified to use for control function an external source of pressure fluid and equipped with pressurized exhaust manifold.

Referring now to FIG. 3, the bypass valve assembly 127 is identical to that of FIG. 2, with the following exceptions. The line 130 of FIG. 2 is dispensed with and the exhaust chamber 129 is connected, through line 200, with the exhaust manifold of the system comprising exhaust lines 202 and 201, which exhaust manifold is pressurized by exhaust pressure relief valve 203, equipped with throttling member 204, biased by spring 205. The groove 157 of the bypass valve assembly 127 is also dispensed with, with high pressure space 154 being isolated, at all times, from space 146. High pressure space 154 is directly connected by line 181 of FIG. 3 with the discharge line of the pump 180.

The unloading valve 170 of FIG. 3 is again identical to that of FIG. 2 and is connected, in an identical way, with space 185, adjacent to the free floating piston 188 and is also connected to leakage orifice 186. The unloading operation of the unloading valves 170 of FIGS. 2 and 3 is identical. The basic difference is operation of the bypass valve assembly 127 of FIG. 3, as compared to that of FIG. 2, lies in the fact that it is supplied with energy, necessary to position the bypass member 135, during the control bypass function, at all times, from the separate source of pressure from the pump 180. The discharge pressure of the pump 180 may be selected at a moderately high level, ensuring fast response of the bypass valve assembly 127, while working in the zone of comparatively low controlled discharge pressures, of the fixed displacement pump 15. Therefore the response of the bypass valve assembly 127 will be higher at low discharge pressures and will provide more stable control at the high discharge pressures of the fixed displacement pump 15. The direction control valves 11 and 12 of FIG. 3 are similar to those of FIGS. 1 and 2, but are provided with additional unloading mechanism, connecting the load sensing ports 41 and 42 and line 67 and 68 with the unpressurized system reservoir, in neutral position of valve spools 31 and 55. Initial displacement of valve spools 31 and 51 from neutral position, in either direction, by cut-off surfaces 196 and 197, in respect to blocking surface 198 and line 194, through action of unloading groove 199, will disconnect the load sensing circuit of direction control valves 11 and 12 from unpressurized system reservoir. The suction check valves 190, 191, 192 and 193, in a well known manner, connect for one way fluid flow the low pressure sides of actuators 13 and 14 with the pressure of the pressurized exhaust manifold, determined by the setting of the exhaust relief valve 203. Therefore load chambers of the direction control valves 11 and 12 cannot be subjected to a pressure lower than the setting of the exhaust relief valve 203. The pressure setting of the exhaust relief valve 203 is so selected, that it is more than capable of actuation of the unloading valve 170 and of compressing the spring 172. This system provides the following advantages and unobvious results. With the valve spools 31 and 55 in neutral position, through the unloading mechanism of the unloading groove 199, the space 169 of unloading valve 170 and load pressure chamber 147 are subjected to the reservoir pressure, equal to that of down stream pressure of the exhaust relief valve 203. Initial displacement of the valve spool 31 in either direction will disconnect the unloading groove 199 and will connect space 169 with load sensing ports 41 or 42. Since, even in absence of load W, load chambers of valves 11 and 12, through the action of suction check valves 190, 191, 192 and 193 are subjected to the exhaust manifold pressure, as dictated by the setting of the exhaust relief valve 203, the unloading valve 170 will be always actuated. Therefore, when using the system of FIG. 3, the bypass valve assembly 127 and specifically the bypass member 135 can be completely unloaded, for minimum pressure drop through ports 142 and passage resistance of the valve, permitting a lower bypass pressure, especially under cold operation condition, with very viscous fluid. As is well known in the art, the setting of exhaust relief valve 203 is relatively insensitive to change in viscosity of the fluid. Another unobvious advantage of this system lies in the fact that not only the bypass horsepower loss is reduced, but the unavoidable minimum loss, represented by the setting of the exhaust relief valve 203, is further utilized to prevent any possible cavitation at the actuators 13 and 14.

Still another unobvious advantage of the arrangement of FIG. 3 lies in the fact that in FIGS. 1 and 2, in absence of the load W, the valve spool 31 or 55 must be moved all the way to connect the inlet chamber 23 with the load chambers 37 or 38, before the actuation of the unloading valve takes place. In the arrangement of FIG. 3, just by exposing, during the initial movement of the valve spool 31, the load sensing port 41 or 42 to the respective load chambers will actuate the unloading valve 170. Therefore the unloading valve 170 can be actuated and system pressurized during the initial movement of the valve spool 31, in anticipation of the flow demand, before the actual connection between the inlet chamber 23 and load chambers 37 and 38 will take place. This feature provides a much faster responding control.

Although this unloading system of FIG. 3 is shown with bypass valve assembly 127 utilizing, for control purposes, the external source of pressurized fluid, this system is equally applicable to the arrangements shown in FIGS. 1 and 2.

The basic system, shown in FIG. 3, can be modified to change the system performance by including components shown in FIG. 3 in dotted lines. A line 207 with check valve 208 and restrictor orifice 209 cross-connects line 181 leading to the pump 180 with the discharge line 20 of the fixed displacement pump 15. The check valve 210 is positioned, for one way flow, in discharge line 20. A bypass line 211 is also provided around the exhaust relief valve 203. With this system modification, since the exhaust relief valve 203 is bypassed, the bypass valve assembly 127 through the bypass member 135 can completely unload the output of the fixed displacement pump 15, using energy from the pump 180. The resulting drop in pressure in line 20 will open the check valve 208 and through restrictor orifice 209 pressure from the pump 180 will be transmitted through line 207 to discharge line 20, closing the check valve 210. Then the pump 180 will provide the energy for unloading of the bypass valve assembly 127 and will also maintain the lines 21 and 22, leading to the inlet chambers 23 of direction control valves 11 and 12 at the discharge pressure of the pump 180. In absence of the load W movement of the valve spool 31 in either direction will connect the pressure in the inlet chamber 23 with the load sensing line 41 or 42, and in a manner as described when referring to FIGS. 2 and 3, will actuate the unloading spool 171 of the unloading valve 170. In a manner as previously described under action of the control spring 145 the bypass member 135 will move into a modulating position, maintaining a constant pressure differential between the load signal pressure and the discharge pressure of pump 15. Rising pressure in discharge line 20 will open the check valve 210, close the check valve 208 and the system will revert to controlling function of loads W. With the modification shown in dotted lines in FIG. 3 the fixed displacement pump 15 can be fully unloaded and maintained at minimum discharge pressure corresponding to minimum horsepower loss while the energy for operation of the unloading valve 170, in absence of load W and the energy for maintaining the bypass member 135 in fully open position is supplied from the pump 180.

The basic operation of the differential bypass valve assembly 10 of FIG. 1 and 127 of FIGS. 2 and 3 is essentially the same, since all of them maintain a constant pressure differential between their respective supply chambers and load pressure chambers. Furthermore all of those valves maintain this constant pressure differential by regulating, through change in position of a bypass member, the amount of fluid bypassed from supply chambers to system reservoirs. All of those systems also use an amplifying stage of a pilot valve, responsive to the controlling pressure differential. All of those systems use the unloading valve utilizing the energy from the external source of pressure to unload the bypass mechanism.

Although the preferred embodiments of this invention have been shown and described in detail it is recognized that the invention is not limited to the precise forms and structures shown and various modifications and rearrangements as will readily occur to those skilled in the art upon full comprehension of this invention may be resorted to without departing from the scope of the invention as defined in the claims.

What is claimed is:

1. A valve assembly comprising at least one housing having an inlet chamber connected to a pump, a load chamber, exhaust means communicable with reservoir means, a source of pressure fluid other than said pump, first valve means for selectively interconnecting said load chamber with said inlet chamber and said exhaust means, load sensing port means selectively communicable with said load chamber by said first valve means, bypass valve means between said inlet chamber and said exhaust means, pilot valve means having means responsive to pressure differential between pressure in said inlet chamber and pressure in said load sensing port means and means supplied by said source of pressure fluid operable to control said bypass valve means to vary bypass flow between said inlet chamber and said exhaust means to maintain a constant pressure differential between said inlet chamber and said load sensing port means.

2. A valve assembly as set forth in claim 1 wherein said means responsive to pressure differential of said pilot valve means includes first force generating means responsive to pressure in said inlet chamber, second force generating means responsive to pressure in said load sensing port means and spring biasing means opposing force developed by said first force generating means.

3. A valve assembly as set forth in claim 1 wherein said pilot valve means has signal generating means operable to transmit a control pressure signal.

4. A valve assembly as set forth in claim 3 wherein said signal generating means of said pilot valve means has fluid throttling means to throttle pressure fluid from said source of pressure fluid.

5. A valve assembly as set forth in claim 3 wherein said bypass valve means has actuating means responsive to control pressure signal of said signal generating means.

6. A valve assembly as set forth in claim 1 wherein said bypass valve means has spring biasing means to bias said bypass valve means towards position to isolate said inlet chamber from said exhaust means.

7. A valve assembly as set forth in claim 1 wherein passage means interconnects said load sensing port means and said pilot valve means and a check valve means in said passage means.

8. A valve assembly as set forth in claim 1 wherein leakage means is interposed between said load sensing port means and said exhaust means.

9. A valve assembly as set forth in claim 1 wherein said means supplied by said source of pressure fluid of said pilot valve means has control signal generating means.

10. A valve assembly as set forth in claim 9 wherein said signal generating means has means to throttle pressure fluid from said source of pressure fluid.

* * * * *